US007503193B2

(12) United States Patent
Schoene et al.

(10) Patent No.: US 7,503,193 B2
(45) Date of Patent: Mar. 17, 2009

(54) BUTTON APPARATUS AND METHOD OF MANUFACTURE

(75) Inventors: Oliver Schoene, New Bern, NC (US); Rolf Schuck, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 394 days.

(21) Appl. No.: 11/218,744

(22) Filed: Sep. 2, 2005

(65) Prior Publication Data

US 2007/0051140 A1 Mar. 8, 2007

(51) Int. Cl.
*D06F 33/00* (2006.01)
*H01H 3/12* (2006.01)

(52) U.S. Cl. ..... 68/3 R; 68/12.23; 200/341

(58) Field of Classification Search ..... 200/341, 200/5 A, 345; 68/3 R, 12.23
See application file for complete search history.

(56) References Cited

U.S. PATENT DOCUMENTS 2,919,493 A * 1/1960 Candor ..... 34/549
5,898,145 A * 4/1999 Su ..... 200/344
6,294,906 B1 * 9/2001 Kuechler ..... 323/371
2005/0183471 A1 * 8/2005 Kang et al. ..... 68/12.27

FOREIGN PATENT DOCUMENTS

JP 02208025 A * 8/1990

* cited by examiner

*Primary Examiner*—Joseph L Perrin
(74) *Attorney, Agent, or Firm*—Russell W. Warnock; James E. Howard

(57) ABSTRACT

A button comprising a core including a face defining at least one slot and a shaft extending outwardly from the face. The core is preferably made from a rigid material. An outer portion is connected to the core and at least partially surrounds the face. The outer portion is preferably made from a flexible resilient material. A relatively flat cap includes a base with a front side and a back side disposed opposite one another. A foil is connected to the front side and at least one rib projects outwardly from the back side. The rib extends into the slot to connect the cap to the core. The face can define three slots and the cap can include three ribs projecting outwardly from the back side. Each rib extends into a corresponding slot to connect the cap to the core.

16 Claims, 8 Drawing Sheets

22

BUTTON APPARATUS AND METHOD OF MANUFACTURE

FIELD OF THE INVENTION

The invention relates to a button apparatus and method of manufacture, and more particularly to a button for a household appliance, such as a washing machine or clothes dryer.

BACKGROUND OF THE INVENTION

Household appliances, such as washing machines or dryers, generally include one or more buttons as input devices to control operation of the appliance. The buttons are generally made from a plastic material and are often a single molded part made from the same material. With a single molded part, the entire part is often molded in the same color. Also, the features of the buttons can be limited due to the material properties of the plastic molded material. In addition, paint or other decorative features may not bond well with some materials.

BRIEF SUMMARY OF THE INVENTION

The present invention provides a button including a core having a face defining at least one slot and a shaft extending outwardly from the face. The core is preferably made from a rigid material. An outer portion is connected to the core and at least partially surrounds the face. The outer portion is preferably made from a flexible resilient material. A relatively flat cap includes a base with a front side and a back side disposed opposite one another. A foil is connected to the front side and at least one rib projects outwardly from the back side. The rib extends into the slot to connect the cap to the core.

In some aspects and in some constructions, the face defines three slots and the cap includes three ribs projecting outwardly from the back side. Each rib extends into a corresponding slot to connect the cap to the core. The ribs can be non-uniformly sized with respect to one another and the slots can be non-uniformly sized with respect to one another. A specific rib can be selectively sized to correspond to a specific slot to assist in the desired alignment of the cap in relation to the core.

In some aspects and in some constructions, the core can be made from a polypropylene material. The outer portion can be made from a rubber material. The base can be made from an acrylonitrate-butadiene-styrene material. The foil includes an inner layer made from a chromium material and an outer layer made from a polymethylmethacrylate material. The inner layer is disposed between the outer layer and the base. The outer portion can be connected to the core with a two cavity molding process. The rib can be fused to the core with a welding process.

In some aspects and in some constructions, the button may be used with a household appliance, such as a washing machine or dryer. The appliance can include a housing, a control panel supported by the housing, and the button mounted in the control panel. The appliance can also include a rotating drum and a drive device coupled to the rotating drum disposed within the housing. The drive device drives the rotating drum in response to actuation of the button on the control panel.

Other features and advantages of the present invention will become apparent to those skilled in the art upon review of the following detailed description and drawings.

BRIEF DESCRIPTION OF THE DRAWINGS

Particular details and further advantages are explained in more detail by reference to the following drawings, which are to illustrate the invention not restrictively, but merely by way of example, wherein there is shown schematically in.

Figure 1:
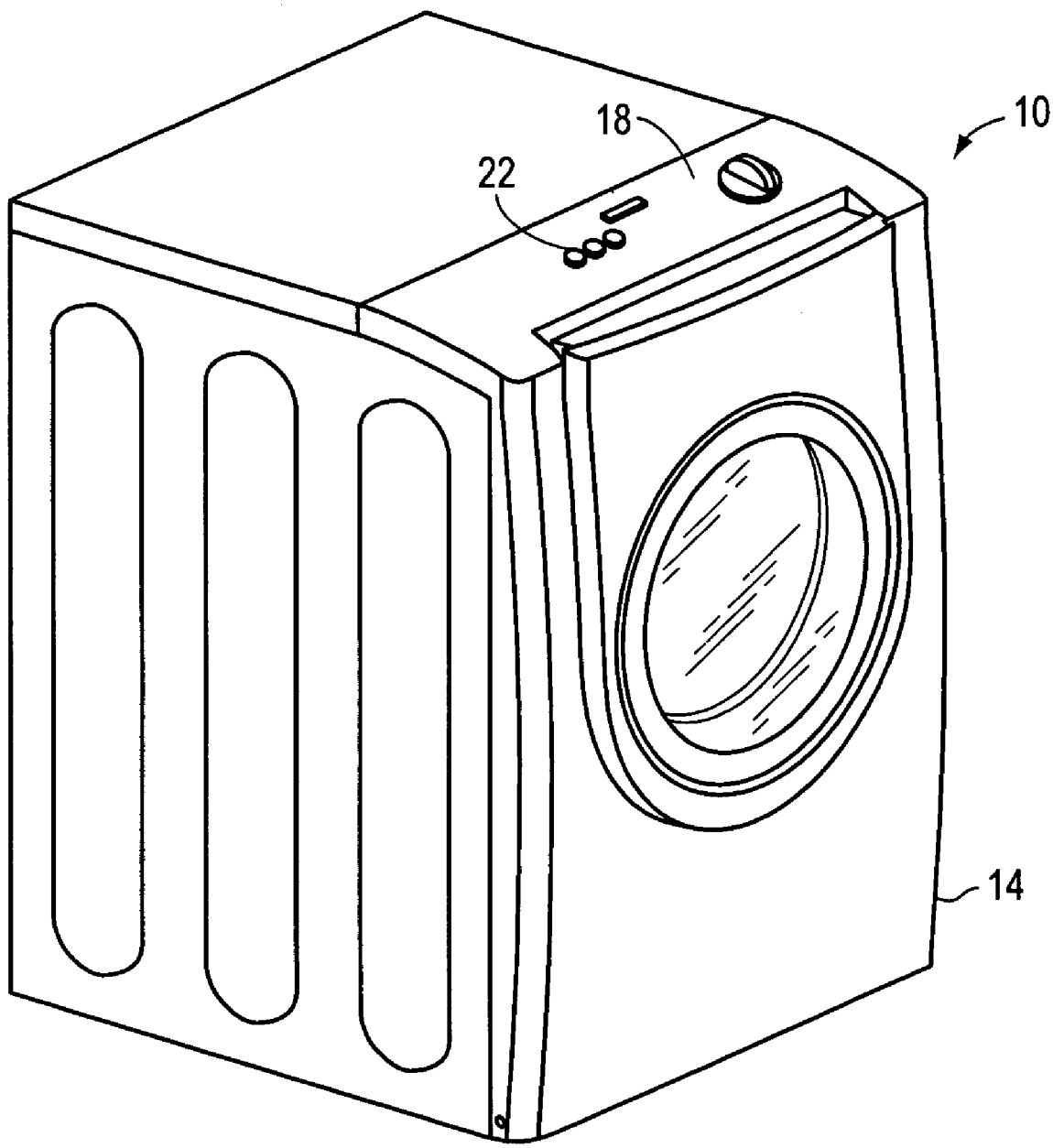
FIG. 1 illustrates a perspective view of a household appliance including a button embodying the present invention.

Before the embodiments of the invention are explained in detail, it is to be understood that the invention is not limited in its application to the details of construction and the arrangements of components set forth in the following description of illustrated in the drawings. The invention is capable of other embodiments and of being practiced or of being carried out in various ways. Also, it is to be understood that the phraseology and terminology used herein is for the purpose of description and should not be regarded as limiting. In addition, the drawings may not be drawn to scale.

DETAILED DESCRIPTION OF THE INVENTION

FIG. 1 illustrates a washing machine 10 having a housing 14 and a control panel 18 with at least one button 22. The washing machine 10 can also include a rotating drum (not illustrated), a drive device (not illustrated), a wash tub (not illustrated), and a control system (not illustrated) disposed within the housing 14. The rotating drum receives laundry and the drive device can include an electric motor that drives the rotating drum. The wash tub at least partially surrounds the rotating drum and retains a washing liquid within the washing machine 10. The operator can push the button 22 to input commands to the control system and control operation of the washing machine 10. The control system can control operation of the drive device and other systems of the washing machine 10 in response to the input commands. For example, the operator can push the button 22 to select a desired preprogrammed wash cycle that is saved in the control system. The button 22 generally engages a switch mechanism to input the desired command.

Figure 2:
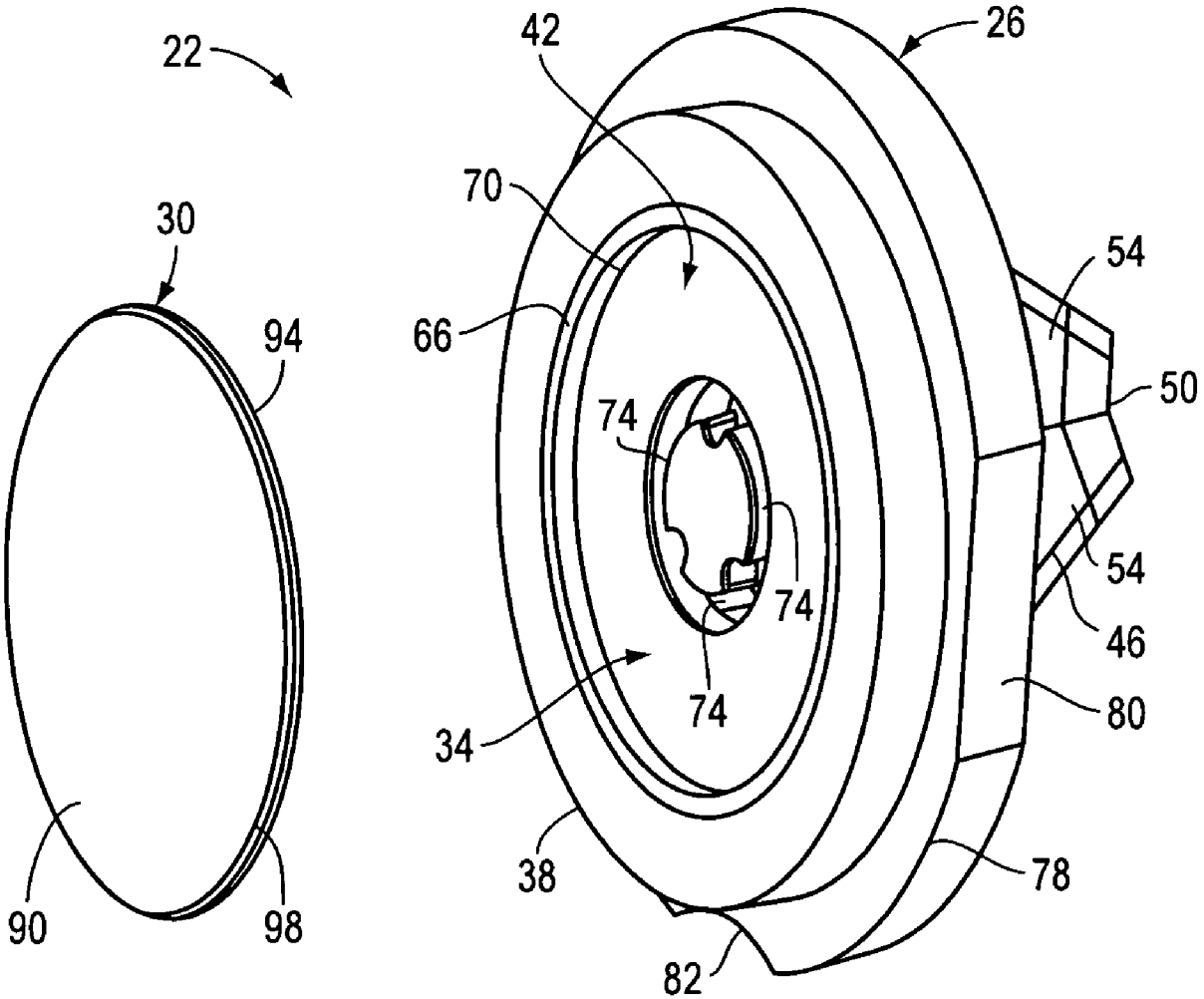
FIG. 2 illustrates a perspective assembly view of the button of FIG. 1.

FIG. 2 illustrates an exploded view of the button 22, including a main body 26 and a cap 30. The main body 26 includes a core 34 and an outer portion 38. In the illustrated construction, the core 34 forms a rigid foundation for the button 22 and is preferably integrally formed from a rigid material, such as polypropylene, or PP. The core 34 includes a face 42 that is relatively flat and round in shape and an elongated shaft 46 extending outwardly from the face 42 to a shaft end 50. In the illustrated construction, the shaft 46 includes three elongated legs 54 that are joined near a central axis and form a Y-shaped cross-section (See FIGS. 5 and 8). The legs 54 are tapered radially inwardly as they extend axially outwardly from the face 42 to the shaft end 50. In the illustrated construction, the legs 54 are not uniformly spaced from one another and the angle between two legs 54 is less than the angle between those two legs 54 and the third leg 54'. This configuration allows the button 22 to be properly aligned when positioned in the washing machine 10 (FIG. 1). This feature is particularly relevant when the button 22 includes writing, figures, or other symbols that require proper alignment in the control panel 18.

Figure 3:
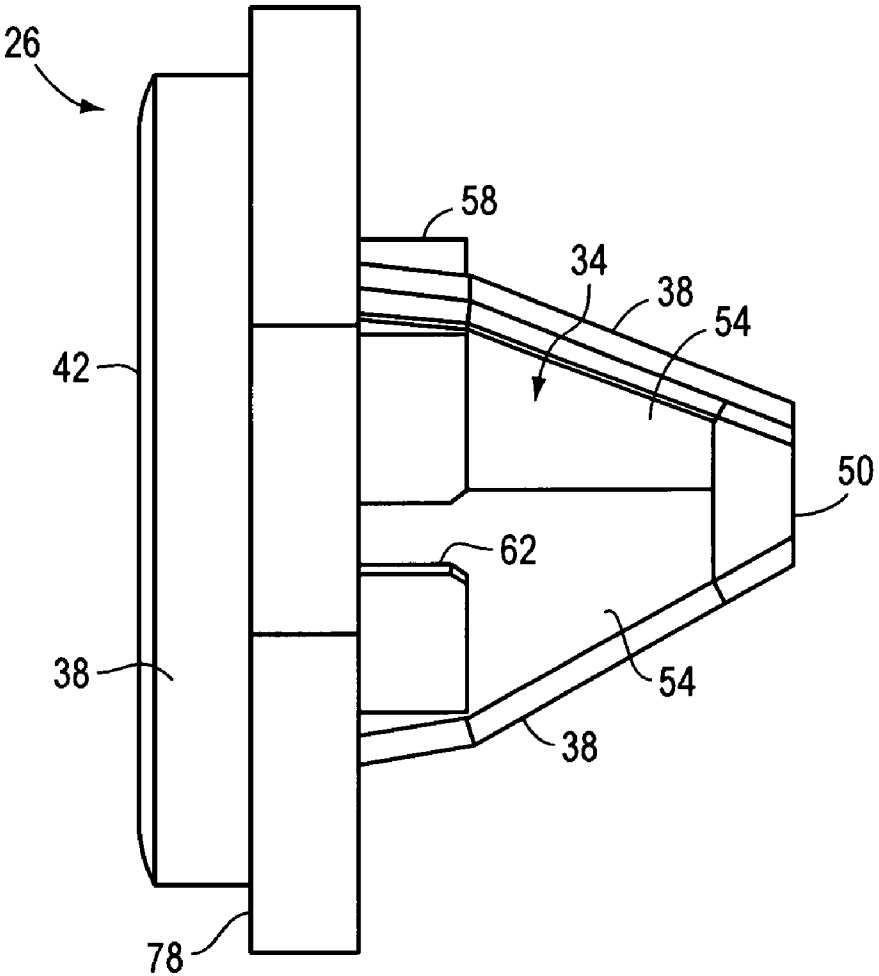
FIG. 3 illustrates a side assembly view of the button of FIG. 1.
Figure 3:
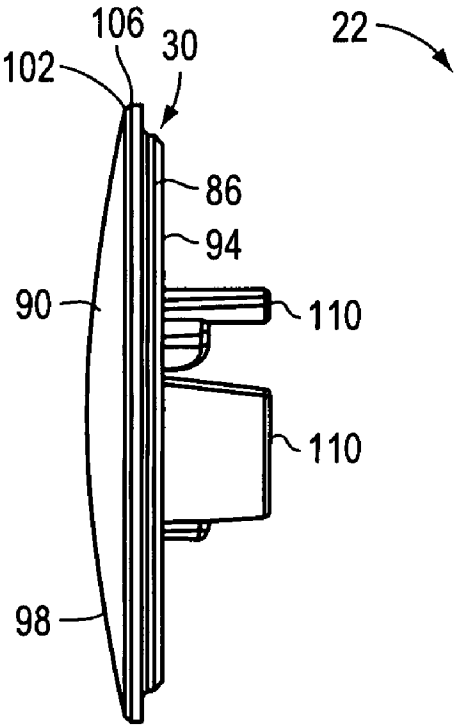
Figure 4:
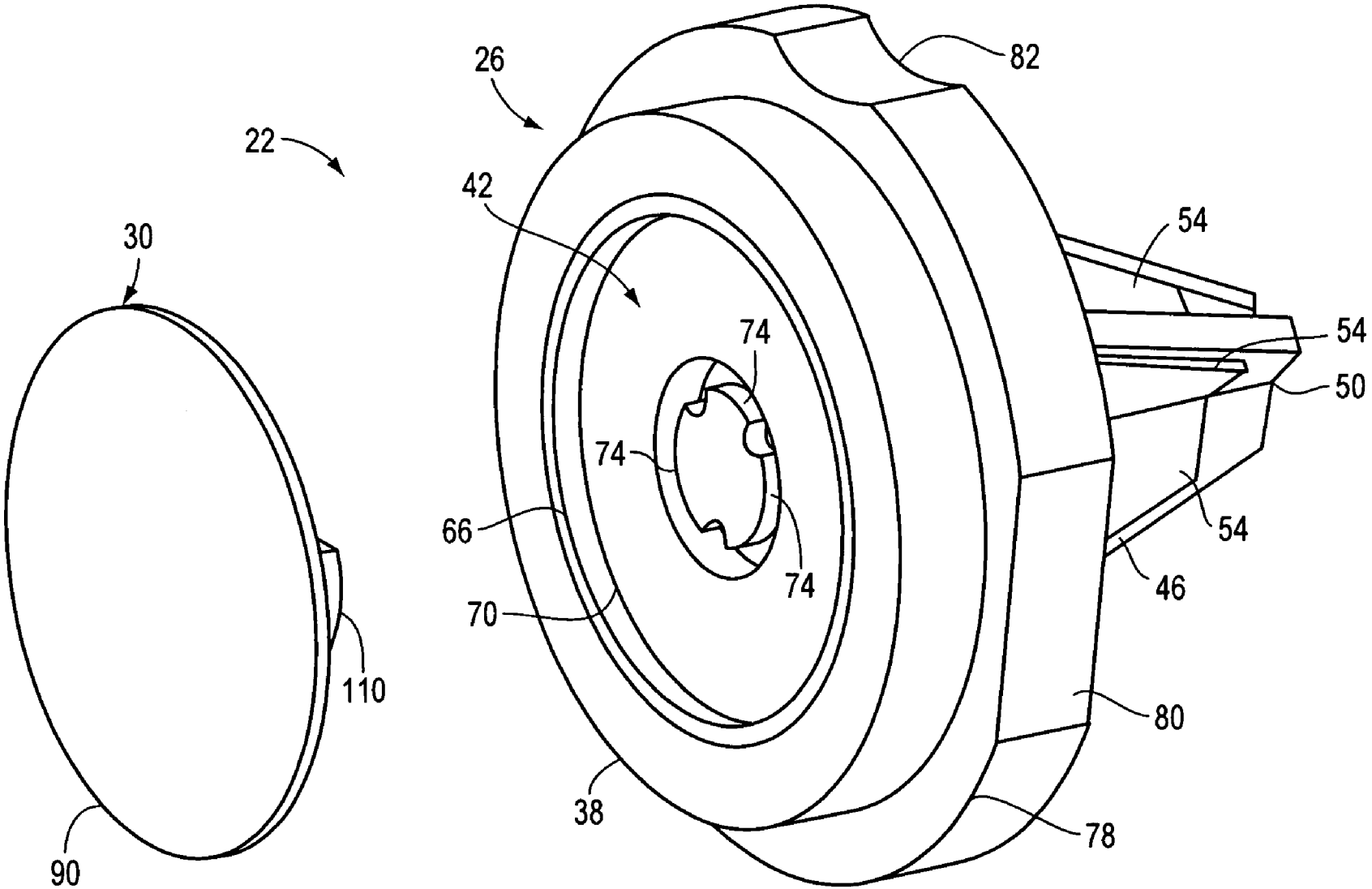
FIG. 4 illustrates a perspective assembly view of the button of FIG. 1.

As shown in FIG. 3, the core 34 also includes a cylindrical wall 58 connected to the face 42 and the legs 54. A cavity is formed behind the face 42 and between legs 54 and the cylindrical wall 58. The cylindrical wall 58 helps provide additional stability for the button 22. The cylindrical wall 58 can also help guide the button 22 during linear travel within an aperture in the control panel 18 (FIG. 1). The cylindrical body 58 can include relief cuts 62 disposed between the legs 54.

As shown in FIG. 2, the face 42 includes a ridge 66 extending along the perimeter of the face 42 and defines a recessed area 70. At least one slot 74 extends into face 42 for engagement with the cap 30. In the illustrated construction, three slots 74 extend through the face 42 and are exposed to the cavity behind the face 42.

The outer portion 38 is connected to the core 34 and at least partially surrounds the core 34. The outer portion 38 is preferably made from a resilient, flexible material, such as rubber. In the illustrated construction, the outer portion 38 is connected to the core 34 with a two cavity molding process. The outer portion 38 can be permanently fixed to the core 34 through this process to form a single unitary piece.

The outer portion 38 surrounds the outer edge of the face 42 of the core 34. The outer portion 38 includes a stepped flange 78 that forms a shoulder beyond the ridge 66 of the face 42. The outer portion 38 also extends along the outer edges of the legs 54 to the shaft end 50. The shaft end 50 can be formed from the same flexible rubber material as the outer portion 38 to help reduce wear and tear on a mating switch mechanism (not illustrated). In addition, the resilient, flexible material of the flange 78 helps provide a biasing spring force for the button 22. The button 22 is generally placed within an aperture in the control panel 18 (FIG. 1) and is depressed in relation to the control panel 18 when an operator actuates the button 22. The biasing spring force of the flange 78 helps return the button 22 to its original position when the actuating force is removed. The rubber flange 78 also helps form a seal around the button 22 to resist moisture, chemicals, dust, debris, particles, and other undesirable substances from entering the control panel 18 (FIG. 1).

The outer portion 38 can include a non-symmetrical feature to help properly position the button 22 in the control panel 18 (FIG. 1). In the illustrated construction, the outer portion 38 includes two opposing straight surfaces 80 and an indentation 82 in an outer edge of the flange 78. The indentation 82 can be aligned with a corresponding feature, such as a boss, near an aperture in the control panel 18 (FIG. 1) to properly align the button 22 with the control panel 18 (FIG. 1). This feature is particularly important when the button 22 includes writing or symbols that should be properly oriented for comprehension by the operator.

As shown in FIG. 3, the cap 30 includes a relatively flat disc shaped base 86 having a front side 90 facing away from the main body 26 and a back side 94 facing toward the main body 26. In the illustrated construction, the base 86 is preferably made from a rigid material,such as acrylonitrate-butadiene-styrene, or ABS. The front side 90 has a rounded convex shape that bulges outwardly. A foil 98 is applied to the front side 90 of the cap 30 and can include a desired distinctive feature, such as a surface effect or coloring. For example, a desired color, material, writing, symbol, logo, pattern or other similar surface effect feature can be placed on the cap 30 with the foil 98.

The foil 98 can include a protective outer layer 102 and a decorative inner layer 106. In the illustrated construction, the protective outer layer 102 is preferably made from a durable, chemically resistant material, such as polymethylmethacrylate (Acrylic), or PMMA. The protective outer layer 102 is beneficial for use with devices such as a washing machine 10, where exposure to bleach and other chemicals is fairly common. In the illustrated construction, the decorative inner layer 106 includes a chromium layer to give the cap 30 a metallic appearance. The PMMA protective outer layer 102 helps shield the inner layer 106 from wear and tear and exposure to abrasive chemicals or other substances.

The foil 98 can be applied to the base 86 with an in-mold decorative foil process. The foil 98 generally forms a good bond with the ABS material of the base 86. In some circumstances, the foil 98 may not bond as well to other plastic materials, such as PP.

As mentioned above, the foil 98 allows various different colors or designs to be placed on the button 22 and helps make the button 22 manufacturing process more flexible. To obtain a different color or design on the button, the foil 98 can be modified while continuing to use the same main body 26 to produce buttons 22. Similarly, when a device includes multiple buttons 22, multiple main bodies 26 can be produced and caps 30 having varying foil portions 98 can be placed on the main bodies 26. Therefore, larger common parts, or main bodies 26, can be produced in greater quantity while the smaller specialized parts, or caps 30, can be produced in smaller quantities as needed and connected to the common main bodies 26.

Figure 5:
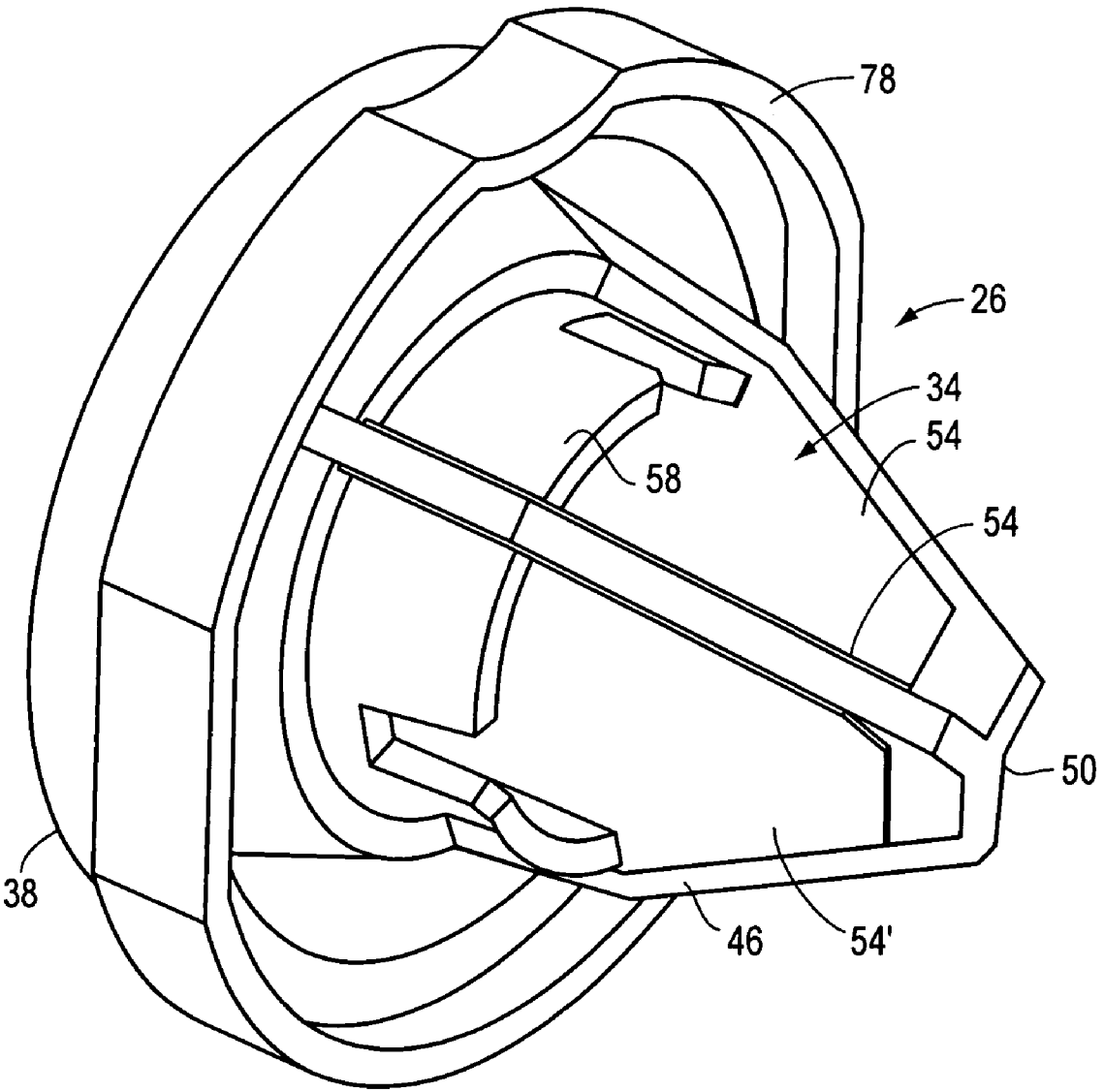
FIG. 5 illustrates a perspective assembly view of the button of FIG. 1.
Figure 5:
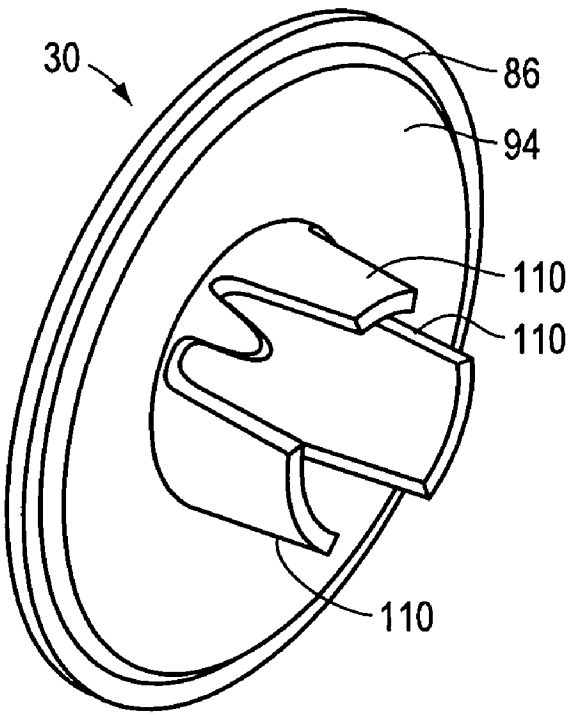

At least one rib 110 projects from the back side 94 of the base 86 and is engage able with the at least one slot 74 in the core 34. As shown in FIGS. 3 and 5 illustrate three ribs 110 projecting from the back side 94 with each rib 110 corresponding to one of the three slots 74 (FIG. 2) in the core 34. In the illustrated construction, the ribs 110 and slots 74 have arcuate cross-sectional shapes and can be arranged to form corresponding sets between each slot 74 and the corresponding rib 110. One corresponding slot 74 and rib 110 set can be shaped differently than the other two corresponding sets to help properly align the cap 30 with respect to the core 34 during assembly. Once again, this feature is particularly important when the button 22 includes writing or symbols that should be properly oriented for comprehension by the operator.

Figure 6:
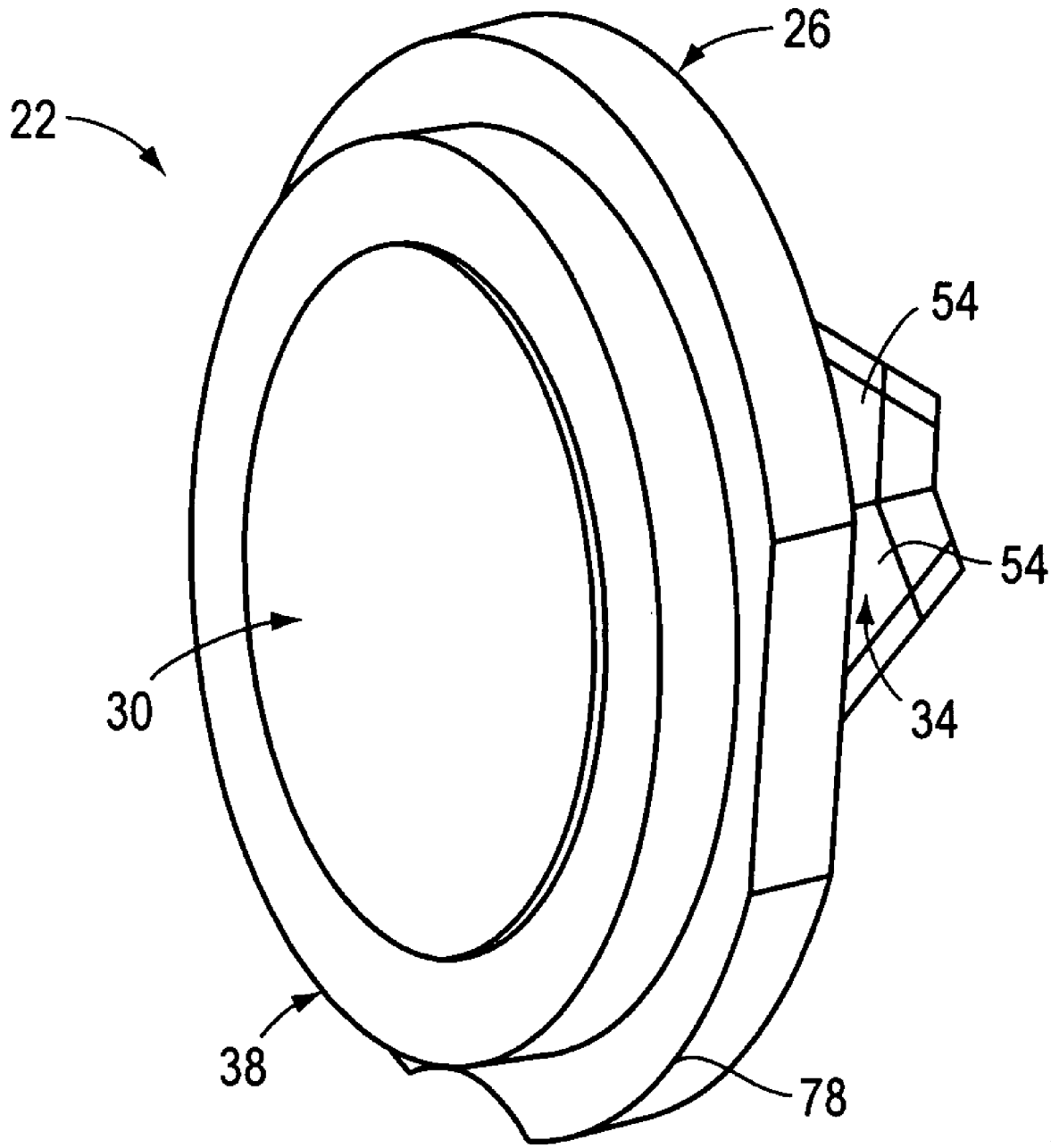
FIG. 6 illustrates a perspective view of the button of FIG. 1.
Figure 7:
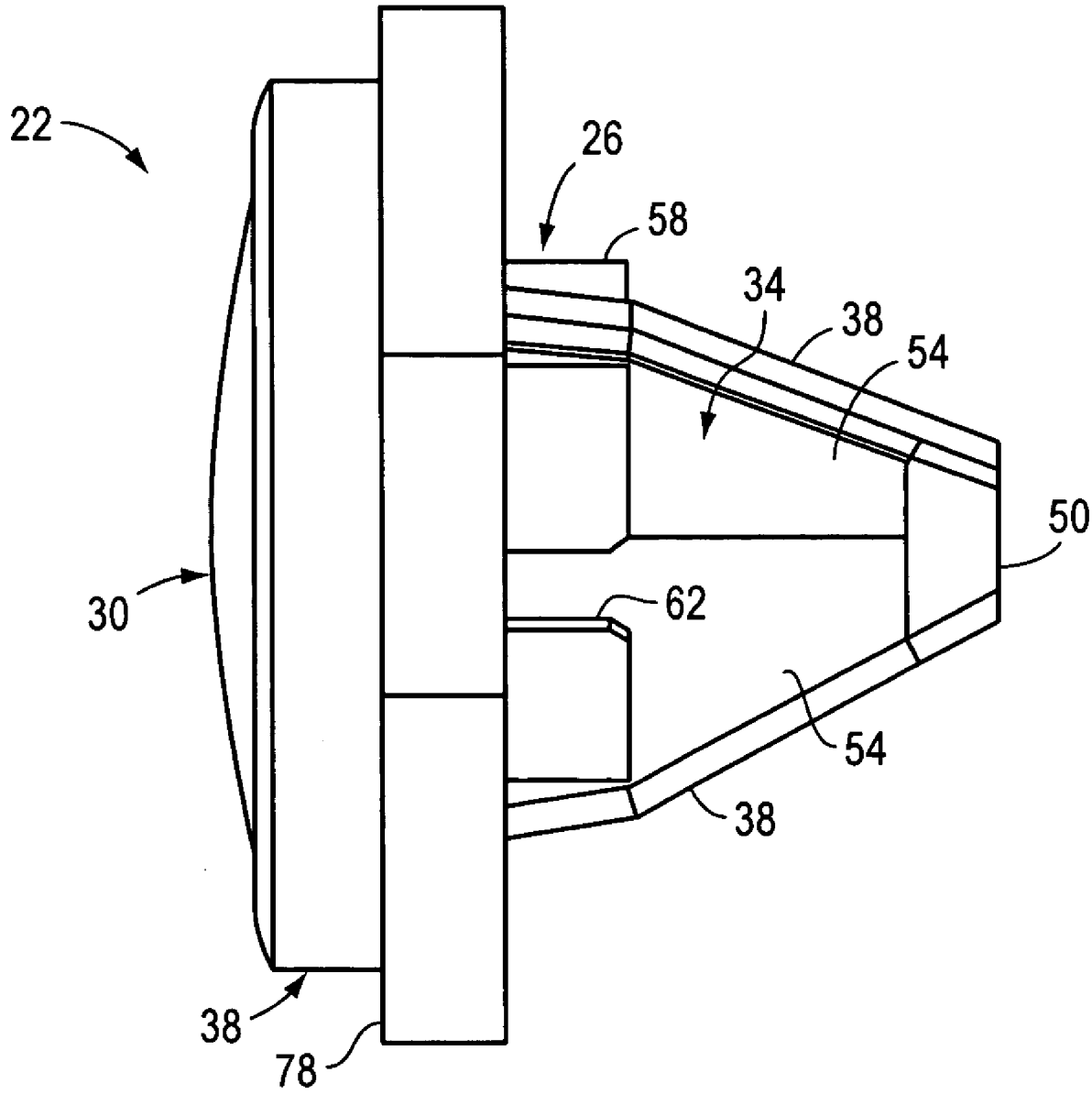
FIG. 7 illustrates a side view of the button of FIG. 1.
Figure 8:
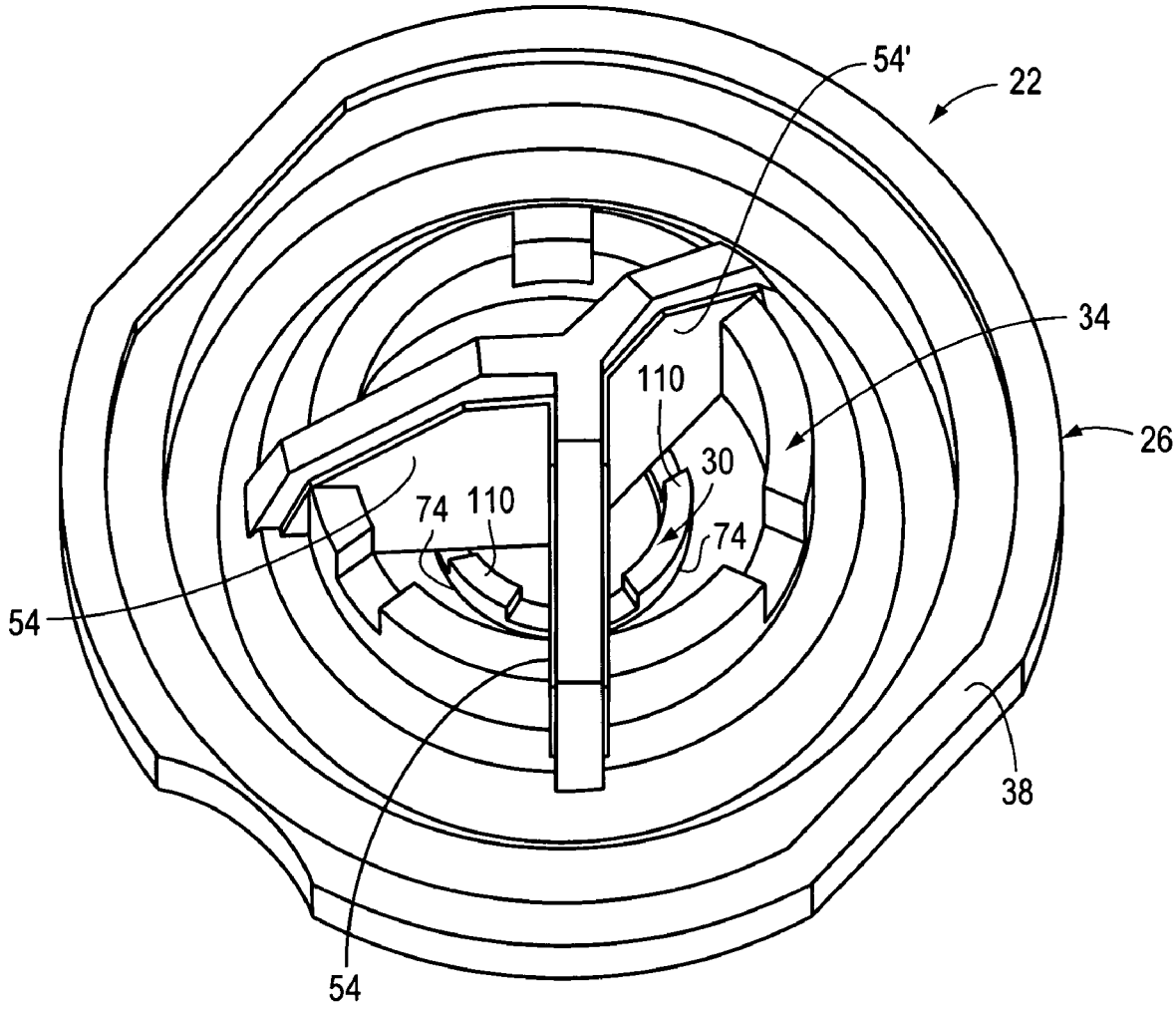
FIG. 8 illustrates a perspective view of the button of FIG. 1.

In the illustrated construction, the cap 30 is connected to the main body 26 by inserting the ribs 110 through the corresponding slots 74 (FIG. 2). FIGS. 6-8 illustrate the cap 30 connected to the main body 26. The cap 30 is positioned at least partially within the recessed area 70 (FIG. 2) of the core 34 and is surrounded by the outer portion 38. FIG. 8 illustrates the ribs 110 extending through the slots 74. The ribs 110 can be connected to the core 34 with an ultrasonic welding process that fuses the cap 30 and main body 26 together. The welded connection forms a substantially permanent connection between the cap and main body and resists the cap 30 from becoming dislodged from the main body 26.

In some aspects and in some constructions, the cap 30 can be connected to the main body 26 with other means. For example, the ribs 110 can form an interference fit with the slots 74 that connects the cap 30 to the main body 26 and retains the cap 30 in the desired position. Also, the ribs 110 can include barbs that form a snap fit with the slots 74 and connect the cap 30 to the main body 26. In addition, other fastening means such as gluing, bonding, or other adhesives can be used to connect the cap 30 to the main body 26.

In the illustrated construction, the button 22 has a generally circular shape. In some aspects and in some constructions, the button 22 can have other shapes, such as square, triangular, or any other desired shape. The flexible manufacturing process permits a wide variety of shapes that can be made for the button 22.

The washing machine 10 shown in FIG. 1 illustrates one possible construction for button 22 and the button 22 can also be utilized on a dryer, dishwasher, oven, refrigerator, other home appliances, or other devices utilizing push button inputs. The button 22 can also be useful in industrial settings or other similar applications where exposure to various chemicals is common.

What is claimed is:

1. A button comprising:

a core, the core being made from a rigid material, the core having a face forming a display side of the core, a reverse side opposite to the display side, at least one slot having an opening on the display side of the core and an opposite opening on the reverse side of the core, and a shaft extending outwardly from the reverse side of the core;

an outer portion connected to the core and at least partially surrounding the face, the outer portion being made from a flexible resilient material; and a relatively flat cap including a base with a front side and a back side disposed opposite one another, a foil connected to the front side, and at least one rib projecting outwardly from the back side of the cap, the rib extending into the slot of the core through the one opening of the slot on the display side of the core and through the opposite opening of the slot on the reverse side of the core, whereupon the rib extends completely through the slot of the core.

2. The button of claim 1, wherein the face includes a ridge defining a recessed area and the cap is at least partially disposed within the recessed area.

3. The button of claim 1, wherein the outer portion is connected to the core with a two cavity molding process.

4. The button of claim 1, wherein the rib is fused to the core with a welding process.

5. The button of claim 1, wherein the face defines three slots and the cap includes three ribs projecting outwardly from the back side, each rib extending into a corresponding slot and connecting the cap to the core.

6. The button of claim 5, wherein the ribs are not sized uniformly with respect to one another and the slots are not sized uniformly with respect to one another.

7. The button of claim 1, wherein the core is made from a polypropylene material.

8. The button of claim 1, wherein the outer portion is made from a rubber material.

9. The button of claim 1, wherein the base is made from an acrylonitrate butadiene-styrene material.

10. The button of claim 1, wherein the foil includes an inner layer made from a chromium material and an outer layer made from a polymethylmethacrylate material, the inner layer being disposed between the outer layer and the base.

11. A household appliance comprising:

a housing;

a control panel supported by the housing, the control panel having a button shaft receiving aperture; and a button mounted in the control panel and including:

a core, the core being made from a rigid material, the core having a face forming a display side of the core, a reverse side opposite to the display side, at least one slot having an opening on the display side of the core and an opposite opening on the reverse side of the core, and a shaft extending outwardly from the reverse side of the core, an outer portion connected to the core and at least partially surrounding the face, the outer portion being made from a flexible resilient material, and a relatively flat cap including a base with a front side and a back side disposed opposite one another, a foil connected to the front side, and at least one rib projecting outwardly from the back side of the cap, the rib extending into the slot of the core through the one opening of the slot on the display side of the core and through the opposite opening of the slot on the reverse side of the core, whereupon the rib extends completely through the slot of the core, and the shaft of the core is received in the button shaft receiving aperture of the control panel.

12. The household appliance of claim 11, wherein the household appliance includes a washing machine having a rotating drum and a drive device coupled to the rotating drum disposed within the housing, the drive device driving the rotating drum in response to actuation of the button on the control panel.

13. The household appliance of claim 11, wherein the face defines three slots and the cap includes three ribs projecting outwardly from the back side, each rib extending into a corresponding slot and connecting the cap to the core.

14. The household appliance of claim 13, wherein the ribs are not sized uniformly with respect to one another and the slots are not sized uniformly with respect to one another.

15. The household appliance of claim 11, wherein the core is made from a polypropylene material, the outer portion is made from a rubber material, and the base is made from an acrylonitrate butadiene-styrene material.

16. The household appliance of claim 11, wherein the foil includes an inner layer made from a chromium material and an outer layer made from a polymethylmethacrylate material, the inner layer being disposed between the outer layer and the base.

* * * * *